US009493948B1

(12) United States Patent
Davidson et al.

(10) Patent No.: US 9,493,948 B1
(45) Date of Patent: Nov. 15, 2016

(54) SELF-SUPPORTING ROOF PANEL

(75) Inventors: Jane Davidson, Edina, MN (US); Susan Mantell, St. Paul, MN (US); Louise Goldberg, Minneapolis, MN (US); John Carmody, Minneapolis, MN (US)

(73) Assignee: Regents of the University of Minnesota, St. Paul, MN (US)

( * ) Notice: Subject to any disclaimer, the term of this patent is extended or adjusted under 35 U.S.C. 154(b) by 1992 days.

(21) Appl. No.: 11/901,280

(22) Filed: Sep. 14, 2007

Related U.S. Application Data

(60) Provisional application No. 60/844,940, filed on Sep. 15, 2006, provisional application No. 60/845,424, filed on Sep. 18, 2006.

(51) Int. Cl.
*E04D 3/35* (2006.01)
*E04B 5/02* (2006.01)
*E04D 11/00* (2006.01)

(52) U.S. Cl.
CPC ..... *E04C 2/50* (2013.01); *E04D 3/357* (2013.01); *E04D 11/005* (2013.01)

(58) Field of Classification Search
CPC ..... E04C 2/3405; E04C 2/365; E04C 2/36; E04C 2/50; E04D 3/18; E04D 3/357; E04D 11/002; E04D 11/005
USPC ..... 52/91, 57, 582.1, 783.1, 783.11, 52/783.18, 783.19
See application file for complete search history.

(56) References Cited

U.S. PATENT DOCUMENTS

| | | | | | |
|---|---|---|---|---|---|
| 1,955,948 | A * | 4/1934 | Collins | 52/783.11 |
| 2,339,220 | A * | 1/1944 | Crowley | 52/282.4 |
| 3,274,739 | A * | 9/1966 | Gregoire | 52/155 |
| 3,732,138 | A * | 5/1973 | Almog | 428/114 |
| 4,147,004 | A | 4/1979 | Day et al. | 52/309.9 |
| 4,335,558 | A * | 6/1982 | Caldwell et al. | 52/13 |
| 4,757,665 | A * | 7/1988 | Hardigg | 52/782.1 |
| 4,879,152 | A * | 11/1989 | Green | 428/73 |
| 4,937,125 | A * | 6/1990 | Sanmartin et al. | 428/116 |
| 5,175,975 | A * | 1/1993 | Benson et al. | 52/788.1 |
| 5,518,796 | A | 5/1996 | Tsotsis | 428/116 |
| 5,673,524 | A | 10/1997 | Gailey | 52/309.9 |
| 5,738,924 | A * | 4/1998 | Sing | 428/68 |
| 5,741,574 | A | 4/1998 | Boyce et al. | 428/119 |
| 5,766,395 | A * | 6/1998 | Bainbridge et al. | 156/222 |
| 6,067,764 | A * | 5/2000 | Johansen | 52/302.1 |
| 6,205,728 | B1 * | 3/2001 | Sutelan | 52/309.7 |
| 6,291,049 | B1 | 9/2001 | Kunkel et al. | 428/99 |
| 6,314,704 | B1 | 11/2001 | Bryant | 52/745.7 |
| 6,455,148 | B1 | 9/2002 | Spears et al. | 428/319.1 |
| 6,460,309 | B1 * | 10/2002 | Schneider | 52/837 |
| 7,147,809 | B2 | 12/2006 | Cowelchuk et al. | 264/46.5 |

(Continued)

FOREIGN PATENT DOCUMENTS

JP 06049959 A * 2/1994 ..... E04D 3/40

*Primary Examiner* — Elizabeth A Quast
(74) *Attorney, Agent, or Firm* — Westman, Champlin & Koehler, P.A.

(57) ABSTRACT

A self-supporting panel is used to form building components, including roofs that have no independent supports for the panels between the ends of the panels. The panel system includes a base support or structural component having a top face sheet supported by longitudinally load carrying webs and a layer of insulation on the exterior of the face sheet. The insulation spans the entire face sheet to overlie connectors between the edges of adjacent panels when the panels are assembled to form a wall or roof, to eliminate thermal shorts.

12 Claims, 4 Drawing Sheets

(56) References Cited

U.S. PATENT DOCUMENTS

| | | | | |
|---|---|---|---|---|
| 7,225,596 | B2 | 6/2007 | Wrass | 52/784.14 |
| 7,255,765 | B2 | 8/2007 | Ruggie et al. | 156/210 |
| 2002/0139082 | A1* | 10/2002 | DeFord et al. | 52/783.1 |
| 2004/0261356 | A1 | 12/2004 | Wrass | 52/782.1 |
| 2008/0086982 | A1* | 4/2008 | Parenteau et al. | 52/794.1 |
| 2008/0236058 | A1* | 10/2008 | Antonie | 52/90.1 |

* cited by examiner

SELF-SUPPORTING ROOF PANEL

This application refers to and claims priority on U.S. Provisional Patent Application No. 60/844,940, filed Sep. 15, 2006, and U.S. Provisional Patent Application No. 60/845,424, filed Sep. 18, 2006, the contents of both provisional applications are hereby incorporated by reference.

This invention was made with government support under a subcontract awarded by Pulty Home Sciences (DOE Prime DE-FC26-04NT42114-A003). The government has certain rights in the invention.

BACKGROUND OF THE INVENTION

The present disclosure deals with a self-supporting roof panel comprising a panel made of face sheets of suitable material for building construction supported by webs positioned at desired spacings across the width of the panel. The webs and sheets extend for the full length of the roof panel. The roof panel is supported only at its ends, for example, on the ridge of a building and on a side wall of the building, with no underlying support structure. Insulation is attached to the supporting structure at the factory and forms an integral component of the panel.

Panels having a pair of sheets spaced apart by web type supports, including honeycomb structures, have been made but none are self-supporting roof panels, as disclosed herein. The self-supporting roof panels simplify building construction.

Reference is made to published U.S. Pat. No. 7,225,596 to Lawrence J. Wrass, which is incorporated by reference.

SUMMARY

The present disclosure relates to a self-supporting roof panel made up of at least one face sheet supported by load carrying longitudinal support members. The panel may include two face sheets, a bottom face sheet, and a top face sheet, supported in spaced relationship by structural or load carrying support spacers, comprising longitudinally extending webs between the sheets. The panels can be formed with insulation layers on the exterior of a face sheet, and then finished with a covering sheet.

The roof panels can be called flat orthotropic sandwich panels, each comprising two face sheets, as shown, and a structural core, as well as including insulation which can be added to one or both of the face sheets. The structural core has individual longitudinally or length extending channel elements, such as a channel shaped structure comprising a web and edge flanges, a hat shaped section, as disclosed herein, and other cross sections such as a "V", a "Z", a "C" or an I-beam shape. Additionally, a folded sheet that zigzags back and forth between the top and bottom face sheets, or a continuously corrugated plate can also be used as webs for the structural core.

The face sheet material may be selected from a wide range of material, including steel, corrosion resistant steel, fiber reinforced plastic, certain stainless steel, wood laminates, bio-based composite materials, aluminum, and wood or wood laminates. Examples of synthetic materials for the roof panels include vinyl, acrylics, polyurethanes, polyesters, or other thermoplastic or thermoset materials or combination of those.

Various fasteners are provided for joining the roof panels side to side, and for connectors at a ridge or a soffit of a building being constructed.

The roof panels can be used for pitched roofs or flat roofs, and made completely waterproof along exposed surfaces. Face sheets with no seams can be utilized for each of the panels. The face sheets may be flat, as shown, arcuate, corrugated or any combinations of those shapes.

The panels can be used for any type of building system, commercial, residential or industrial, and because they can be unsupported across a substantial span between end supports, use of the roof panels is not restricted by the roof topology.

The panels are suitable for continuous manufacturing in a factory by having the top and bottom sheets on continuous rolls, moving in a direction along the length of the webs that are put into place, and with automatic welding or other joining techniques used for securing the webs to the face sheets. The exterior layer of insulation used can be added in a continuous process as well and foamed in place, that is, coated on the roof panel, as well as being in preformed sheets applied to the panels.

DETAILED DESCRIPTION OF EXEMPLARY EMBODIMENTS

Figure 1:
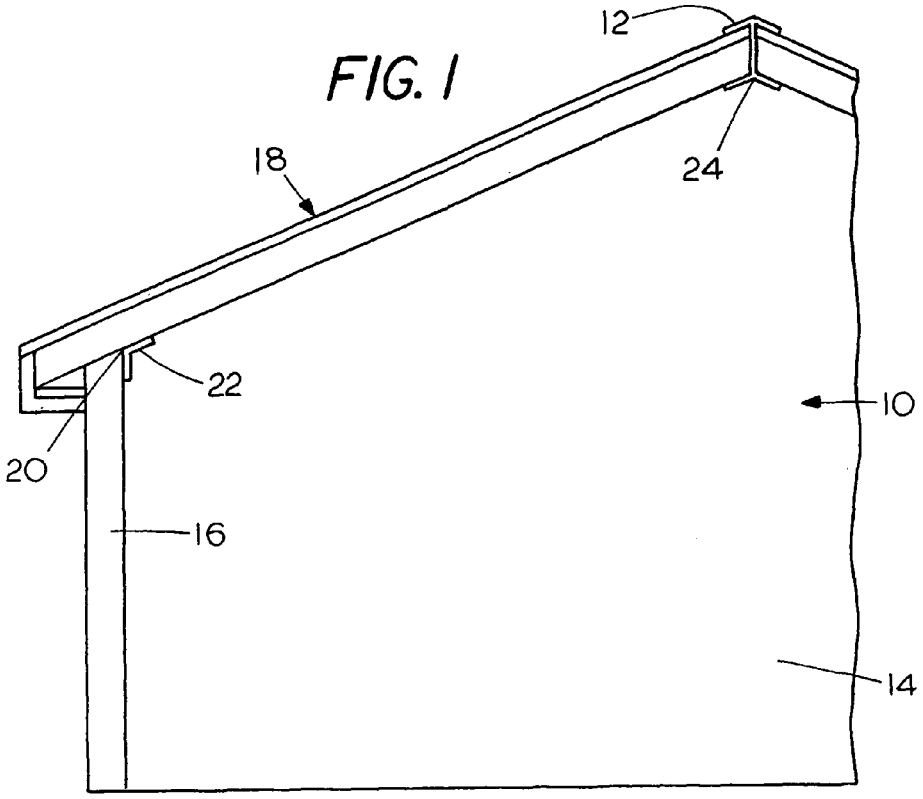
FIG. 1 is a schematic representation of a typical roof panel made as disclosed shown in position between a ridge and a soffit of a building.
Figure 2:
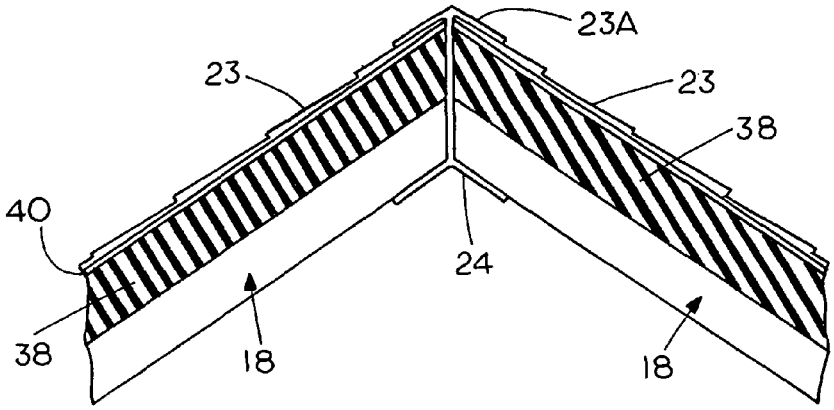
FIG. 2 is an enlarged cross sectional view of a representative building ridge detail for roof panels of the present disclosure.
Figure 3:
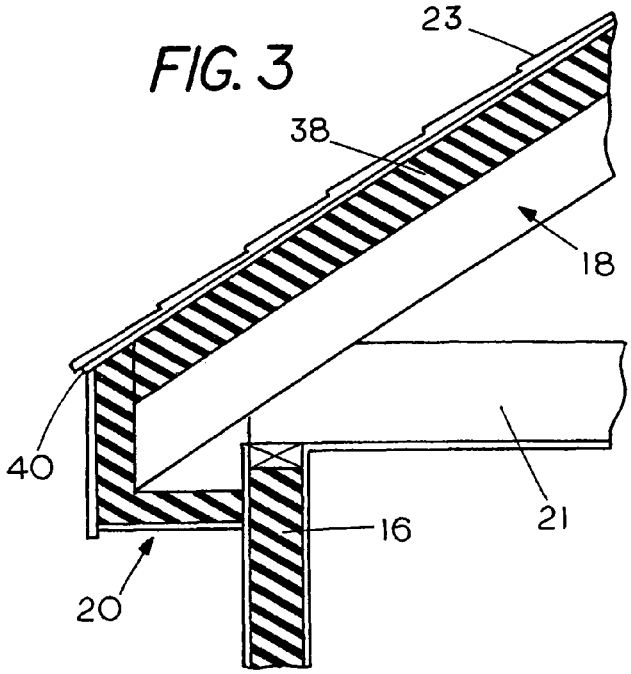
FIG. 3 is an enlarged cross sectional view of a representative roof panel support at a side wall of a building.

Referring first to FIG. 1, for a general view of an installed roof panel, a typical building 10 is shown only schematically, and includes a ridge 12 that extends between end walls 14. A side wall is shown schematically at 16. A roof panel 18 made according to the present disclosure is shown installed and supported at the ridge 12 at one end, and on the side wall 14 at a soffit region 20 adjacent the other end of the panel. As shown in more detail in FIG. 3, the support for the roof panel 18 in the soffit region 20 includes support on a ceiling panel 21, which can be a panel without insulation, and which is supported on the top of wall 16. A suitable ridge attachment bracket 24 is shown in FIG. 2 at 12. As shown in detail the panels may have roofing 23, and a ridge cap 23A, which can be selected as needed.

The roof panels, are thus unsupported except where they meet the wall or connect at the ridge, and there are no internal supports between the wall 16 and the ridge 12. The inclined roof shown in FIG. 1 is merely for reference purposes, and the roof panels can be utilized for flat roofs or roofs of any desired pitch.

Figure 4:
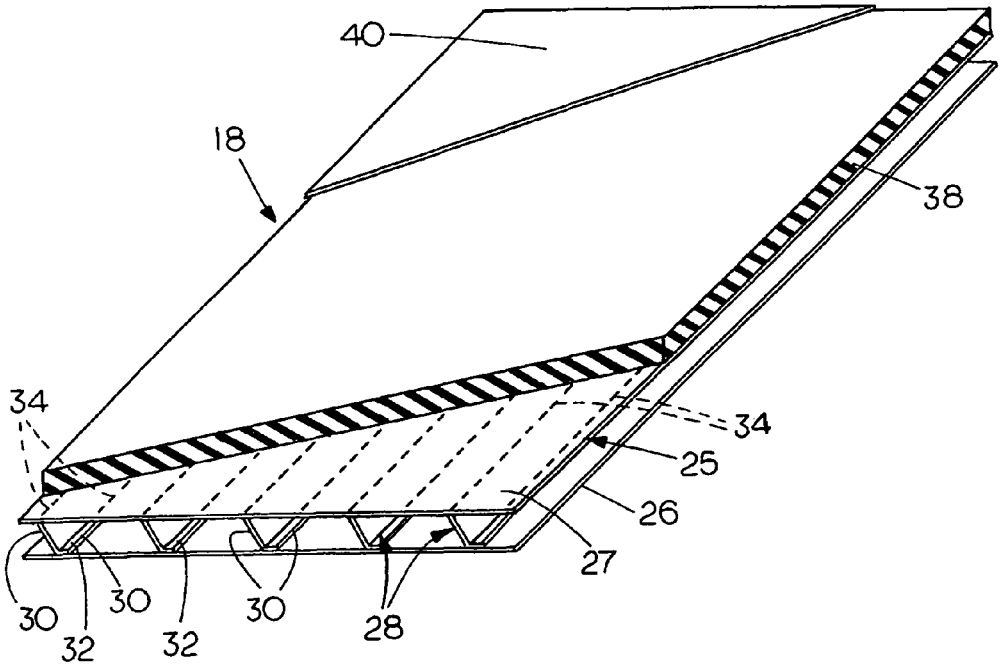
FIG. 4 is a schematic perspective view of a section of a typical roof panel shown in FIG. 1 with V shaped webs.

FIG. 4 illustrates a section or portion of one form of the panel 18, in greater detail. In the disclosure of FIG. 4, the truss core panel 18 includes a bottom face sheet 26, and a top face sheet 27 which are spaced apart and substantially parallel. The top and bottom sheets are held into a "sandwich" construction by a plurality of webs 28 between the top and bottom face sheets. The top and bottom face sheets and the webs form the structural component for the panel. The face sheets 26 and 27 and the webs 28 extend along a length dimension (that is between the soffit and the ridge in FIG. 1). These webs 28 are, as shown, made of a relatively thin sheet metal formed into a "V" channel shape that has legs 30 that extend between the face sheets 26 and 27 and are welded thereto, and a narrow base 32 which is used for securing the web to the bottom or base face sheet. The webs are, as shown, secured by continuous laser welding, or spot welding, for example, if the sheets 26 and 27 and the webs 28 are formed of weldable metal. The weld locations are indicated by dotted lines 34. If the face sheets 26 and 27 and the webs 28 are made of a material that cannot be welded, the lines 34 represent the location for securing the face sheets and the webs together. The face sheets and webs may be secured with epoxy, other adhesives, rivets, spot welding, or other suitable fasteners needed for the materials, the application loads, the environment or other factors. Suitable adhesive or fasteners may be used with synthetic materials, composite materials, and wood. The welds or fasteners must be adequate to carry the loads. A typical maximum lateral spacing of welds or fasteners on the compression side (the top as shown) is 175 to 300 mm, depending on the design load on the panel, and the span.

The face sheets and webs are thus held in a rigid sandwich type assembly that has a width perpendicular to the length, and which can be made in any size suitable for use and/or transport. Manufacturing equipment that automatically welds or secures the webs in position after the webs are laid onto a bottom or base face sheet 26 may be used. The top face sheet 27 would be placed over the webs, for securing them in place in a continuous process.

The roof panel 18, including the structural component indicated generally at 25, comprising the two face sheets and the webs held together securely, has a layer 38 of suitable insulation material secured on the outer surface of the top face sheet. The insulation could similarly be attached to the bottom face sheet. The layer 38 of insulation may be polyurethane foam, high density polyethylene foam, or other foams having high insulation value. The layer of foam is held in place with suitable adhesives, or other fasteners. The insulation may be foamed in place, or in preformed panels or sheets.

The insulation layer 38 provides thermal and sound insulation. In this form of the disclosure, the insulation layer 38 is not a structural member but serving only primarily as insulation.

Insulation layer 38 could be laid on the structural component 25 of the panel in a continuous process as well, as the panel 18 is moved in direction along its length or longitudinally, and the insulation laid down and secured in place. The upper or outer surface of the insulation layer 38 would be maintained smooth, so that an additional finish sheet or covering 40 could be added to the top of the layer. Sheet 40 demonstrates a top or final finish sheet of the panel 18. The side that is exposed to the weather would have roofing 23 selected to be of a suitable material and construction to resist the elements. Normally, the sheet 40 could be a metal sheet, or a composite material. The sheet 40 would be secured to the insulation layer 38.

The panels 18 also can be sealed at their ends to provide for exclusion of moisture from the interior openings between the webs 28 as supported by the face sheets 26 and 27. In some climates, and in some panel constructions, vapor barriers can be used to prevent condensation. As shown, the webs 28 are spaced inwardly from the longitudinal edges of the face sheets, but the insulation extends to the edges of the face sheet.

Figure 5:
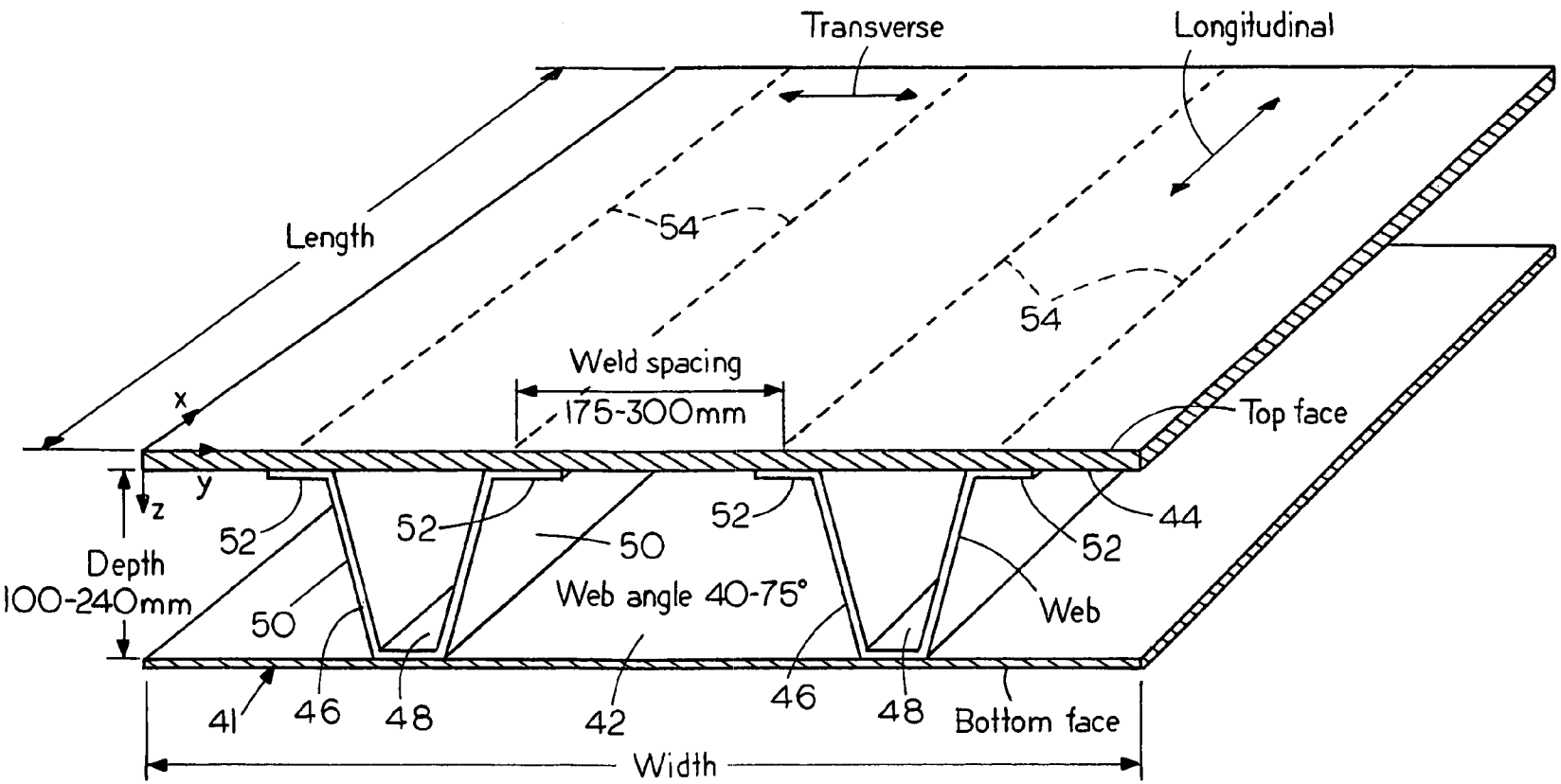
FIG. 5 is an end perspective view of a modified form of a roof panel of the present disclosure, with typical suggested construction information.
Figure 6:
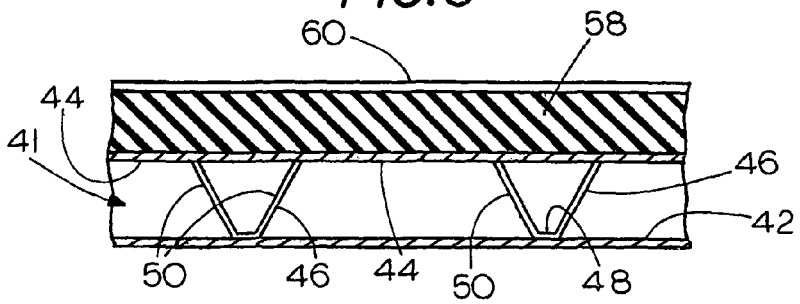
FIG. 6 is a fragmentary end view of the roof panel of FIG. 5.

FIGS. 5 and 6 shows a structural component 41 with an alternate configuration of webs. The structural component 41 can include a bottom face sheet 42 and a top face sheet 44 that are spaced apart and substantially parallel, and held in a sandwich construction with webs 46, that are spaced along the width of the sheet. Webs 46 in this form of the disclosure are "hat shaped" and have a base 48, and legs 50 which extend upwardly at a suitable angle from the edges of the base 48. The upper or top edges of the legs 50 of the webs 46 have flanges 52 extending laterally outwardly therefrom, and these flanges 52 form a surface for supporting the top face sheet 44. Assuming that the top and bottom face sheets are made of a suitable sheet metal, as are the webs 46, continuous laser welding or other types of welding can be used along the dotted lines indicated at 54, so that the top face sheet is joined to the flanges 52, and then suitable welds, or other fasteners, such as rivets, adhesives and the like indicated by the dotted line 56 can be used for welding or securing the base 48 of each web to the bottom face sheet.

In a typical application where metal face sheets and webs are utilized, the bottom face sheet and the top face sheet would have selected design thicknesses and the height and lateral spacing of the webs are selected to meet the load carrying requirements, usually specified by building codes. Many variables are considered in the design of the panels, including the overall length of the panel as related to the distance between end supports. The lateral spacing between the webs, the height of the webs, the strength of the material used for the face sheets and webs, and other factors. It is desired to keep the roof panels at a reasonable low weight per square meter. See Table I below for typical design criteria.

The form of the disclosure shown in FIGS. 5 and 6 includes an insulating foam sheet 58 provided on the top of the top face sheet 44, as previously shown in FIG. 4, and an exterior finish sheet 60 can be provided over the insulation material layer 58. Also roofing material would be provided as needed for rafter use.

The width of the roof panels is determined not only by size limitation in manufacturing, but also by shipping size limitations. Panel widths of 2.4 meters (eight feet) are most likely to be used, but greater width can be made. The panel length can be as needed for the particular construction being envisioned, and generally speaking, the length also would be limited to the maximum length for transportation, which at the present time, is in the range of from 5-6 meters because of truck length limitations.

In both forms of the panels shown in FIGS. 4 and 5, the materials for the face sheets and the web can be selected from a wide variety of different materials including steel, corrosion resistant steel, stainless steel, aluminum, composite materials such as fiber reinforced plastics, biomaterial based composites, wood composites, and wood panels. Wood panels could be used with metal webs, or with wood webs that were substantially planar and joined to the top and bottom face sheets. In other words, such wood webs would likely not have flanges for attachment but an edge would be secured to each of the face sheets for attachment.

The panel side edges are closed by having the webs right at the sides and closure panels can be used for closing or capping the panel ends. Sealing structures for joining the panels to each other at panel joints, and at joints at the ridge or soffit of a building on which they are installed are used as well.

Again, the depth of the webs, that is the dimension spacing the bottom and top face is selected to be sufficient to provide rigidity and load carrying capability when the roof panels are supported only at their ends, with no internal supports, in a home attic for example. Table I provides design information as examples but without limitation.

TABLE I

| Truss-core panel |
|---|
| The following specifications and dimensions are typical for roof or ceiling applications (note in a ceiling design there is no foam layer):<br>Materials: sheet metals such as aluminum, steel, stainless steel; fiber reinforced composites, wood, wood laminates, bio-based composites.<br>Range of thicknesses: |
| Face sheet thicknesses: 0.75 mm to 2 mm<br>Web thicknesses: 0.5 mm to 2 mm<br>Overall panel depth (excludes external foam): 100 mm to 240 mm<br>Overall panel depth with the foam: 275-360 mm<br>Lateral weld spacing for steel materials<br>maximum weld spacing on the compression side of the panel, 175-300 mm<br>Orientation of the hat section webs 46 is with the open side of the hat on the compression side of the panel (see FIG. 5)<br>Thicker face sheet may be used on side of panel loaded in compression (top face in FIG. 5)<br>Typical weights: structure only 5-9 lbs/ft$^2$ (weight per unit surface area)<br>Structure with exterior foam: 8-12 lbs/ft$^2$ |

Figure 7:
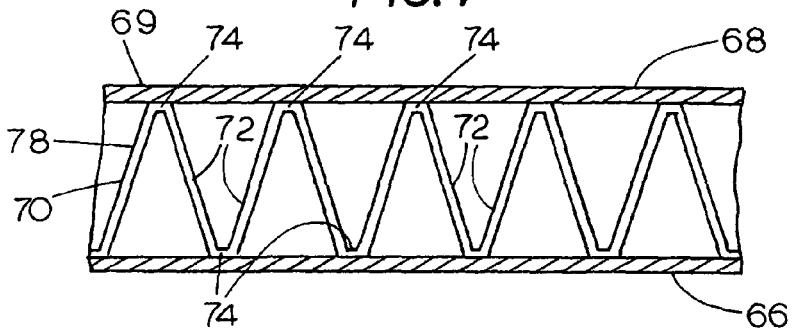
FIG. 7 is an end view of a modified web arrangement of the panels disclosed.

The cross section shape of the webs is not limited to those which have been disclosed, but in FIG. 7, an additional example of a structural component 67 is illustrated. Top and bottom face sheets 66 and 68 are supported spaced apart with a web formed as a continuous folded sheet or plate indicated at 70. As can be seen, this web 70 is formed by folding a plate to form tapered legs 72 at each of the individual sections, which are joined together by bases 74 that can be a selected width to form a plurality of web portions and for permitting welding or using other securing members between the outer surface of the bases 74 and the respective top and bottom face sheets 66 and 68.

The lateral spacing between the bases 74 can be altered from that shown, and the FIG. 7 showing is merely for illustrative purposes only and not to scale.

If the continuously folded plate 70 is made of a composite material, it could be an extruded web, joined to the face sheets with suitable adhesives at the bases 74. If the continuous folded plate web is made of thin metal, and the face sheets 66 and 68 are metal, the sheets can be welded to the bases 74 with continuous welds or spot welding.

Figure 8:
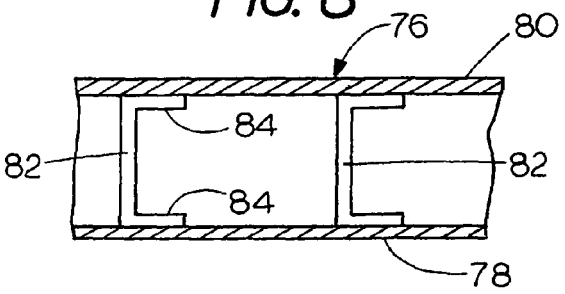
FIG. 8 is a further modified form of web shape utilized.

FIG. 8 shows a schematic, not to scale modified structural component 76 having a bottom face sheet 78 and a top face sheet 80 joined together with "C" shaped webs 82 that have top and bottom legs 84 that can be joined suitably to the top and bottom face sheets 76 and 78, respectively.

Figure 9:
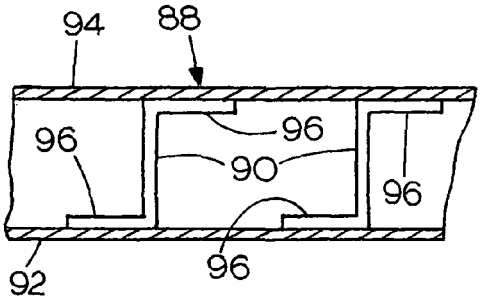
FIG. 9 is a fragmentary end view of a panel utilizing a "Z" type web.

FIG. 9 illustrates a schematic, not to scale, structural component 88 that includes webs 90 made in a "Z" configuration, to hold a bottom face sheet 92 spaced from a top face sheet 94 in a sandwich construction. Legs 96 of the "Z" shape webs 90 can be suitably secured or joined to the top and bottom face sheets 94 and 92, respectively in a manner selected to be compatible with the material used, for example welding, adhesives, or rivets.

Other web cross sections can be utilized as desired, and the face sheets would be held secured to the webs to form the structural components for the roof panels.

The roof panels are intended for use as self-supporting roof structures, such that no interior frame work is required to support the roof panels while in service life. The roof panels can be supported during construction, but there is no need after the construction is completed. Various internal structural elements can be used for attachment of the roof panels to knee walls, and an interior rafter frame if desired. The roof panels that have been shown in the figures have been made to support desired layers of insulation when needed, and will be structural sound as well as providing for the thermal loading requirements of building applications.

Figure 10:
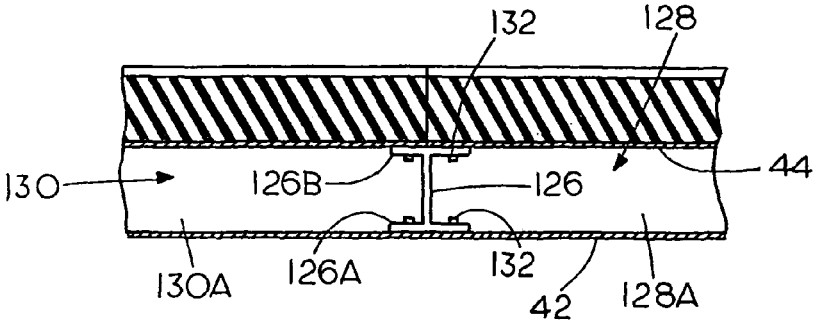
FIG. 10 illustrates a bracket or connector that may be used to join panels side by side.

FIG. 10 shows a connector 126 that joins panels 128 and 130 together edge to edge. Connector 126 has flanges 126A and 126B which are secured to the face sheets 42 and 44 of the panel portions 128A and 130A of the panels with fasteners 132.

Connector 126 does not pass through the insulation layer, which can be continuous across the junction line between the panels. The junction line between the panels in FIG. 10 can be covered with suitable roofing materials for water exclusion.

These connectors can be fastened in with rivets, welding, adhesive or other selected fasteners.

The panel materials and the size of the webs, the spacing of the webs, and other geometry for construction are selected so that the roof panel form is capable of carrying all the dynamic and static loads applied to a building roof. Insulation can be structural foam or bats or panels of foam on the outer surface as shown, or on the interior inner surface if desired. The foam can be integrated within the panel roof interior to satisfy building thermal insulation and acoustic requirements.

TABLE II that follows below lists typical panel construction design requirements steel and stainless steel materials for the web and face sheets calculated for different wind and snow loading in three climate conditions specified by the International Residential Code. Climate I has the lowest design load and climate III has the highest design load.

TABLE II

| Panel type | Web Material | R-value (m$^2$-K/W) | Panel Depth (mm) (in.) | Panel Weight (N/m$^2$) (psf) |
|---|---|---|---|---|
| | | Climate I | | |
| Face sheets and webs | Carbon Steel | 5.3 ($R_{US}$-30)<br>7.0 ($R_{US}$-40) | 275 (10.8)<br>320 (12.5) | 403 (8.4)<br>423 (8.8) |
| | | Climate II | | |
| Face sheets and webs | Carbon Steel | 5.3 ($R_{US}$-30)<br>7.0 ($R_{US}$-40) | 276 (10.9)<br>320 (12.6) | 455 (9.5)<br>476 (9.9) |
| | | Climate III | | |
| Face sheets and webs | Carbon Steel | 7.0 ($R_{US}$-40) | 363 (14.4) | 568 (11.9) |

The panels, illustrated in the figures, have separate structural and insulating components incorporated into one panel. The insulation is attached to a steel (as shown) structural component. The structural component is comprised of two face sheets and an internal web. The internal web might consist of individual channel elements (for example V, Z, C or I), a continuous folded plate, a hat shape, or a continuous corrugated plate. The face sheet separation leads to excellent bending stiffness. The web provides significant shear stiffness. The panel edges may include features for panel to panel joints and joints at the ridge or soffit of the building, as shown The face sheet thicknesses are allowed to differ. Improved buckling performance with a minimal impact on overall panel deflection and weight have been achieved. The panel geometry can be to minimize weight and cost for a particular loading and depth.

Three options for insulating truss-core panels include warm-sided panel with insulation on the top face, a cold-sided panel with insulation on the bottom face, and a panel with the interior space filled with insulation. The warm sided option minimizes the temperature gradient across the structural component, provides superior hygrothermal performance particularly at the soffit, ridge and panel-to-panel joints, and eliminates thermal bridging across the structural component. The most likely insulating material is polymer foam.

The face sheet material may be selected from a wide range of material, including steel, fiber reinforced plastic, stainless steel, wood laminates, bio-based composite materials, aluminum, and wood or wood laminates. Examples of synthetic materials for the roof panels include polyurethanes, polyethylene, or other thermoplastic or thermoset materials or combinations of those.

The sheets and webs may be secured with epoxy, other adhesives, rivets, spot welding, laser welding, or other suitable fasteners suitable for the materials, application loads, environment, or other factors. Combinations of fasteners or fastener types can be used.

The foam shown can be foamed or formed in place, in other words coated on, or made of preformed panels. As disclosed, the roof panels shown herein can be preformed in a factory.

Although the present invention has been described with reference to preferred embodiments, workers skilled in the art will recognize that changes may be made in form and detail without departing from the spirit and scope of the invention.

What is claimed is:

1. A roof panel for a building, said roof panel being supported only at a side wall of the building and at a roof ridge of the building, said roof panel comprising:

spaced apart first and second face sheets, each face sheet having a surface defined by spaced longitudinal edges and end edges;

a load carrying support web structure of strength to support the roof panel secured to the surfaces of the spaced apart face sheets, said web structure providing strength to permit supporting the roof panel only at the side wall and the roof ridge of the building without intervening supports;

an insulation layer secured on an exterior of either the first face sheet or the second face sheet, the insulation layer extending to cover the entire surface of the first face sheet or the second face sheet and wherein the insulating layer is non-structural; and a longitudinally extending connector member along one longitudinal edge for joining a second self supporting roof panel longitudinal edge, said connector member underlying the insulation layers of the joined self supporting roof panels, with no portion of the support web structure and connector passing though the insulation layers.

2. The roof panel of claim 1, wherein said insulation layer comprises a foam insulation layer.

3. The roof panel of claim 1 wherein the first or second face sheet is a waterproof sheet.

4. The roof panel of claim 3 further comprising a layer of roofing material on an exterior of the waterproof sheet.

5. The roof panel of claim 1, wherein said the load carrying web structure comprises a plurality of longitudinally extending web, said longitudinally extending webs being spaced from each other, and the webs having the same cross sectional shape selected from a group consisting of a C-shape, a Z-shaped, and a V-shaped.

6. The roof panel of claim 1 further characterized by the load carrying web structure comprising a continuously folded plate forming V-shape cross section portions and joined to both of the first and second face sheets at folds of the continuously folded plate.

7. The roof panel of claim 1 further characterized by the load carrying web structure comprising individual longitudinally extending webs between the first and second face sheets, and the webs adjacent longitudinal side edges closing a space between the face sheets.

8. The roof panel of claim 1 wherein said the load carrying web structure comprises a plurality of individual longitudinally extending webs, said webs each having a cross sectional shape that is substantially hat-shaped, including a base supported on one of the first or second face sheets, legs extending from said base toward the other of the first or second face sheets, and inclined to spread apart in direction toward the other of the face sheets, and the legs having flanges at ends of the legs opposite from the base, the flanges forming a surface for supporting the other of the first or second face sheets.

9. The roof panel of claim 1, wherein said web structure comprises a plurality of longitudinally extending and parallel webs spaced apart wherein each of the parallel webs is attached to the first and second face sheets along parallel and longitudinal lines.

10. The roof panel of claim 9 and wherein the plurality of parallel webs are spaced a uniform distance apart from each other across.

11. The roof panel of claim 9 and wherein the plurality of parallel webs have the same cross sectional shape selected from a group consisting of a C-shape, a Z-shaped, and a V-shaped.

12. The roof panel of claim 1 wherein the web structure comprising a continuously folded plate forming V-shape cross section portions, and joined to both of the first and second face sheets at folds of the continuously folded plate along parallel lines.

* * * * *